US007009105B2

(12) United States Patent
Chou

(10) Patent No.: US 7,009,105 B2
(45) Date of Patent: Mar. 7, 2006

(54) BUNDLE TWISTED-PAIR CABLE

(75) Inventor: Chih-Hsien Chou, San Jose, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/001,262

(22) Filed: Nov. 30, 2004

(65) Prior Publication Data

US 2005/0077067 A1 Apr. 14, 2005

Related U.S. Application Data

(63) Continuation of application No. 10/649,084, filed on Aug. 26, 2003, now Pat. No. 6,825,410, and a continuation-in-part of application No. 10/229,640, filed on Aug. 27, 2002, now Pat. No. 6,794,570.

(60) Provisional application No. 60/406,135, filed on Aug. 26, 2002.

(51) Int. Cl.
*H01B 7/00* (2006.01)

(52) U.S. Cl. ..... 174/27; 174/113 R

(58) Field of Classification Search ..... 174/27, 174/32, 36, 110 R, 113 R, 120 R
See application file for complete search history.

(56) References Cited

U.S. PATENT DOCUMENTS

| | | | | |
|---|---|---|---|---|
| 4,381,426 | A * | 4/1983 | Cronkite et al. | 174/117 F |
| 4,413,469 | A * | 11/1983 | Paquin | 57/293 |
| 4,873,393 | A * | 10/1989 | Friesen et al. | 174/34 |
| 5,132,488 | A * | 7/1992 | Tessier et al. | 174/34 |
| 5,424,491 | A * | 6/1995 | Walling et al. | 174/113 R |
| 5,767,441 | A * | 6/1998 | Brorein et al. | 174/27 |
| 5,814,768 | A * | 9/1998 | Wessels et al. | 174/110 FC |
| 5,834,697 | A * | 11/1998 | Baker et al. | 174/113 R |
| 6,153,826 | A * | 11/2000 | Kenny et al. | 174/27 |
| 6,254,924 | B1 * | 7/2001 | Brorein et al. | 427/117 |
| 6,323,427 | B1 * | 11/2001 | Rutledge | 174/113 R |
| 6,348,651 | B1 * | 2/2002 | Chou et al. | 174/27 |
| 6,355,876 | B1 * | 3/2002 | Morimoto | 174/27 |
| 6,452,094 | B1 * | 9/2002 | Donner et al. | 174/27 |

* cited by examiner

*Primary Examiner*—William H. Mayo, III
(74) *Attorney, Agent, or Firm*—Wei Te Chung

(57) ABSTRACT

A cable includes a plurality of twisted pairs of conductors in a dense hexagonal matrix-like form defining thereof horizontal rows and oblique columns with each other in a rectangular coordinate system wherein the twisted pairs in the same row have the same twist direction while having opposite twist directions with those in the two neighboring rows aside, and wherein for each row there is a ninety degrees phase shift between every adjacent two pairs and for each column there is a non-ninety degrees phase shift between every adjacent two pairs.

16 Claims, 9 Drawing Sheets

90 degrees 90 degrees 0 degree

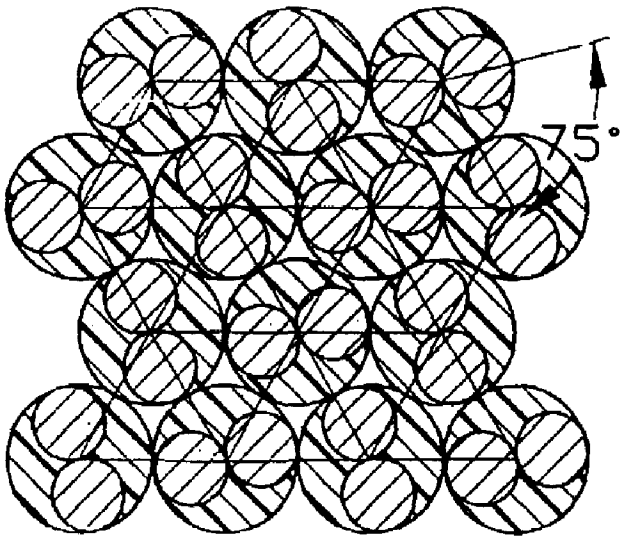
30 degrees
FGI. 4B
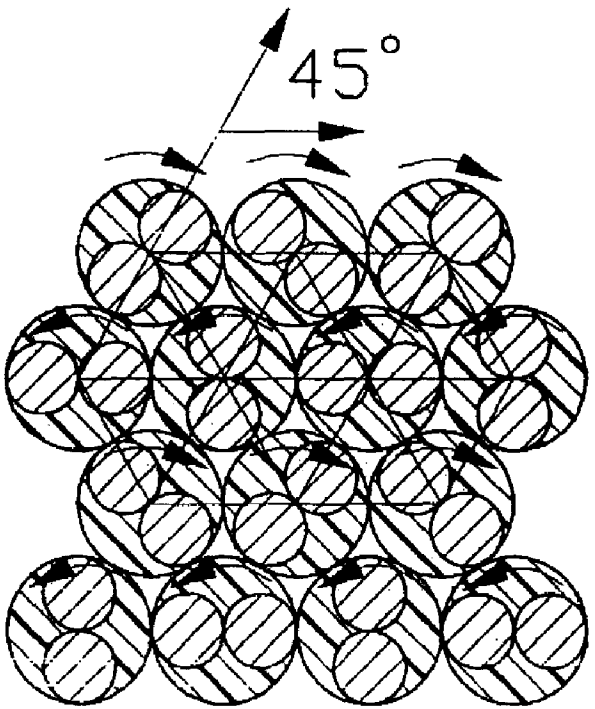
0 degree
FGI. 4A 90 degrees 45 degrees 20 degrees 0 degree 60 degrees 40 degrees 0 degree 75 degrees 135 degrees

BUNDLE TWISTED-PAIR CABLE

This application is a continuation application of a application Ser. No. 10/649,084, filed Aug. 26, 2003, now U.S. Pat. No. 6,825,410, which claims the benefit under 35 U.S.C.§ 119(e) of a U.S. provisional application Ser. No. 60/406,135 filed Aug. 26, 2002, and is a Continuation-in-Part (CIP) application of an application Ser. No. 10/229,640 filed Aug. 27, 2002, now U.S. Pat. No. 6,794,570.

BACKGROUND OF THE INVENTION

1. Field of the Invention

The invention relates to the twisted pair cable, and particularly to the cable having a bundle of twisted pairs of conductors.

2. The Related Art

U.S. Pat. No. 6,348,651 with the same applicant and the same assignee, discloses an approach to implement low crosstalk of a flat cable having a plurality of twisted pairs (of conductors) closely side by side arranged one another. The arrangement of those plural twisted pairs is essentially concerned about a two dimensional design. Anyhow, sometimes the conductors of the cable is required to be of a bundle type in some applications. In other words, a three dimensional arrangement among the twisted pairs of conductors is required to implement the low crosstalk. U.S. Pat. No. 6,355,876 ('876 patent) discloses an approach to lower the crosstalk. Anyhow, even though the '876 patent tries to introduce a unique way to replace the traditional random trial-and error method for a better result, differentiation of the pitch among different pairs seems still unsystematic and complicated in manufacturing. The two self-twisted pairs require to be further mutually tangled/interleaved with each other. The varied pairs may cause some non-uniform impedance and propagation delay. The cross cancellation among the twisted pairs requires the common-integer turns, thus taking a longer distance for implementation of such crosstalk cancellation. It questionably fits the high frequency, and still needs another trial-and-error to figure out the lay variations, (referring to different pitches of the different twisted pairs mentioned in column 5, lines 41–57). Additionally, the four twisted pairs as disposed in FIG. 2 of the '876 patent, can be not densely/compactly/evenly arranged with one another, thus taking much space.

An object of the invention is to provide a scientific, systematic, and easy way to lower the crosstalk among the three dimensionally arranged twisted pairs of conductors.

In the aforementioned applicant's previous patent, i.e., U.S. Pat. No. 6,348,651 ('651 patent), it is proved that the twisted pairs with different/opposite twisting directions may each other cancel out the crosstalk noise with around a ninety degrees phase shift where the phase shift is calculated from the offset of the twist starting point or node point between the adjacent pairs, referring to FIG. 2A. Thus, under a controlled/precise manner, the shift angle is expected to be equal to 360 * offset (distance)/the twist pitch, as shown in FIG. 1. It is noted that the '651 patent discloses the adjacent two twisted pairs having the opposite twist directions (i.e., clockwise and counterclockwise) because it is derived from FIG. 2 of the '651 patent which is an advanced design relative of FIG. 1 of the '651 patent wherein the two adjacent twisted pairs have the same twist direction (i.e., either clockwise or counterclockwise). Anyhow, the same technology, i.e., the ninety degrees phase shift was considered to be also applicable to the cable shown in FIG. 1 of the '651 patent with the same result (referring to FIG. 2B), except that the radiation/field of the cable in FIG. 2 of the '651 patent may be deemed eliminated due to opposite twist directions between every adjacent two twisted pairs while that of the cable in FIG. 1 of the '651 patent may be accumulated larger due to the same twist direction between every adjacent two twisted pairs without roughly the field cancellation benefit at the far end of the cable.

The copending parent application Ser. No. 10/229,640 discloses a three-dimensional arrangement of a bundle of twisted-pair cable essentially composed of a plurality of twisted differential pairs arranged in a quadrate manner among the neighboring pairs. Anyhow, such a quadrate arrangement is not a densest one of the bundle of twisted pairs. In fact, a hexagonal compact package for such twisted pairs can achieve the most compact size.

SUMMARY OF THE INVENTION

The invention is to use both the twisted pairs with the same twist direction and those with the opposite twist directions to form the matrix type arrangement so as to provide a bundle of twisted pairs of conductors in a three dimensional arrangement with one another with the lower crosstalk based on the so-called phase shift theory between the adjacent two twisted pairs as disclosed in the applicant's earlier U.S. Pat. No. 6,348,651 which is concerned about the two dimensional arrangement.

According to an aspect of the invention, a cable includes a plurality of twisted pairs of conductors in a dense hexagonal matrix-like form defining thereof horizontal rows and oblique columns to each other in a rectangular coordinate system wherein the twisted pairs in the same row have the same twist direction while having opposite twist directions wit those in the two neighboring rows aside, and wherein for each row there is a ninety degrees phase shift between every adjacent two pairs and for each column there is a non-ninety degrees phase shift between every adjacent two pairs. Therefore, according to the theory introduced in the earlier U.S. Pat. No. 6,348,651 and the parent application Ser. No. 10/229,640, the self-cancellation of crosstalk occurs along each row and column, thus resulting in low crosstalk at the far end of the cable.

Another aspect of the invention is to have each twisted have the same phase shift with regard to all the neighboring twisted pairs.

Another aspect of the invention is to present an equation to achieve the phase shift among any three neighboring twisted pairs in the hexagonal compactly packaged twisted pairs.

BRIEF DESCRIPTION OF THE DRAWINGS

FIG. 4A shows the hexagonally arranged twisted pairs having a 90 degrees shift between the neighboring twisted pairs in the same row while having a 75 degrees phase shift between the neighboring twisted pairs in the different rows, when one of said twisted pairs is viewed at its 0-degree position.

FIG. 4B shows the hexagonally arranged twisted pairs having a 90 degrees shift between the neighboring twisted pairs in the same row while having a 75 degrees phase shift between the neighboring twisted pairs in the different rows, when one of said twisted pairs is viewed at its 30-degree position.

DETAILED DESCRIPTION OF THE PREFERRED EMBODIMENTS

Figure 1:
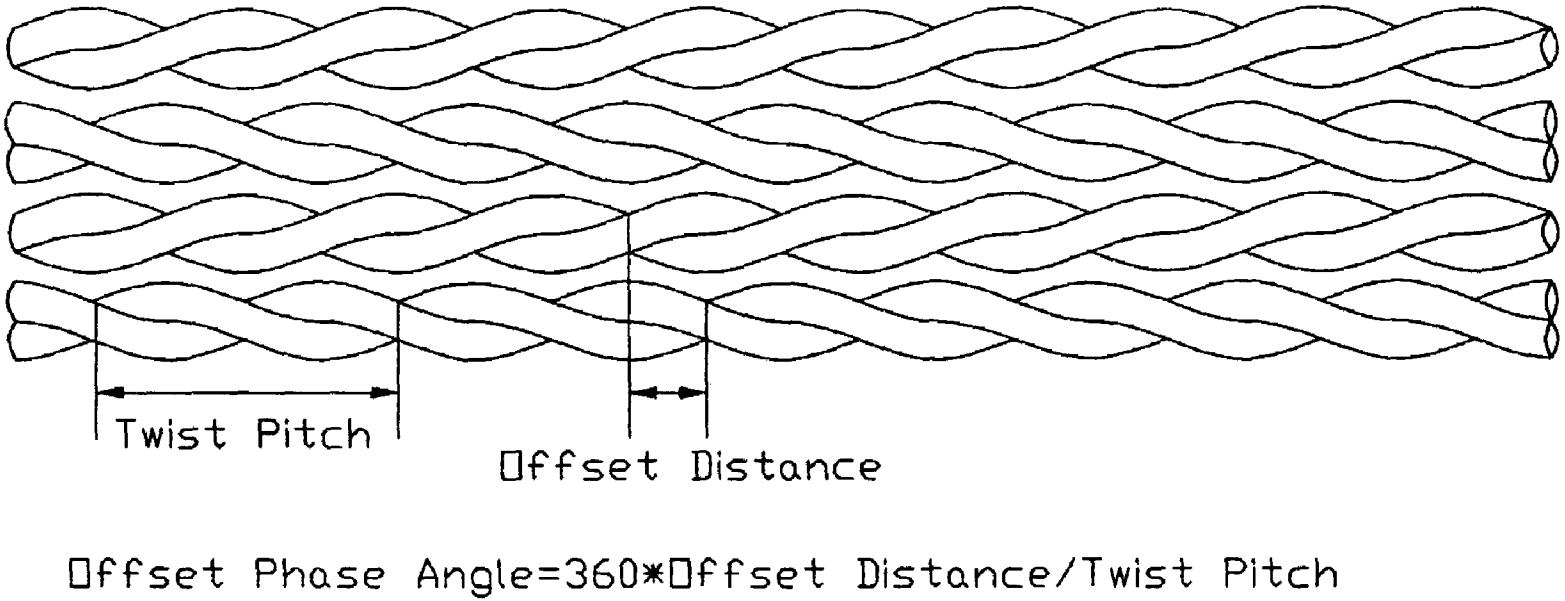
FIG. 1 (PRIOR ART)
FIG. 1 is an illustrative figure reflecting the main figure of the earlier invention disclosed in U.S. Pat. No. 6,348,651.
Figure 2A:
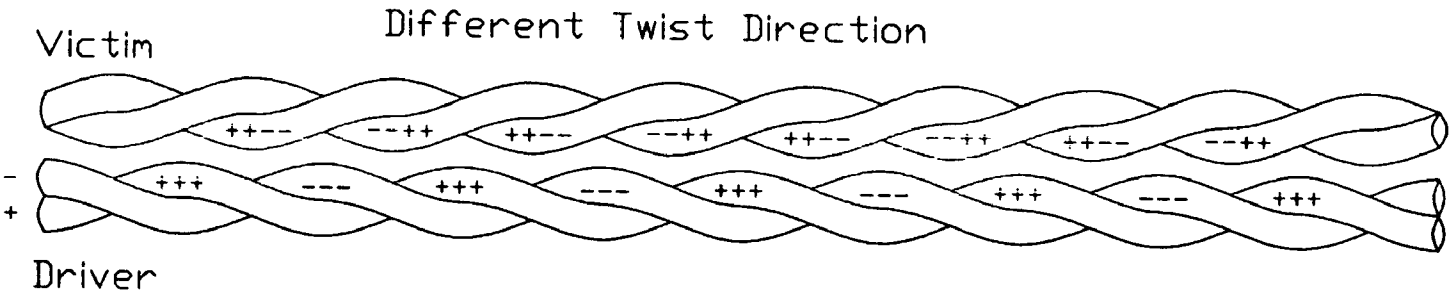
FIG. 2A (PRIOR ART)
FIG. 2A shows the adjacent two twist pairs with the opposite twist directions and the self-cancellation of the crosstalk thereof.
Figure 2B:
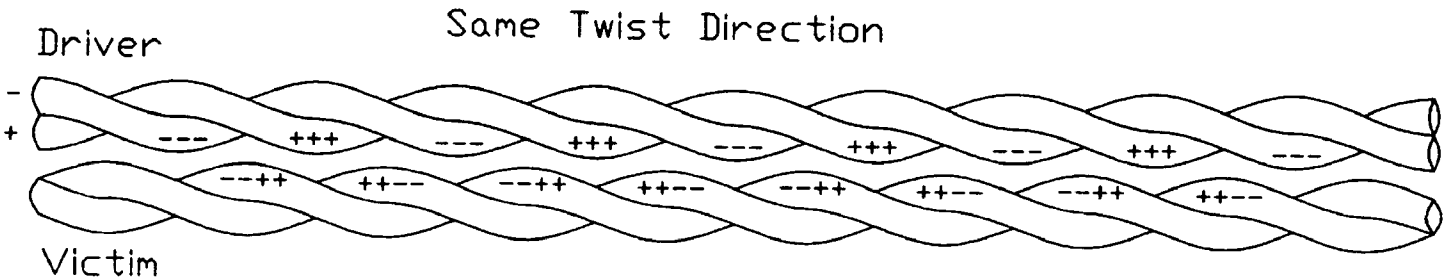
FIG. 2B (PRIOR ART)
FIG. 2B shows the adjacent twist pairs with the same twist direction and the self-cancellation of the crosstalk thereof.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims. It is noted that FIGS. 3A–7C are not precise cross-sectional views but via a similar means for illustrating the domestic and global relations among the neighboring twisted pairs.

It will be noted here that for a better understanding, most of like components are designated by like reference numerals throughout the various figures in the embodiments. The definition of the local coordinate system and global coordinate system are same as what is defined in the parent application. The phase shift between the two adjacent twisted pairs means that when the line defined by two core centers of one twisted pair is aligned with the coordinate axis, the included angle between that line of the twisted pair and that of the other twisted pair. First of all, it should be understood that as mentioned in U.S. Pat. No. 6,348,651, a 90-degree phase shift between the neighboring twisted pairs is desired to reduce the crosstalk. Anyhow, unlike the quadrate arrangement, it is impossible to arrange all the neighboring twisted pairs having 90-degree phase shift to each subject twisted pairs. The following embodiments show several approaches to obtain the maximum crosstalk noise cancellation.

Figure 3B:
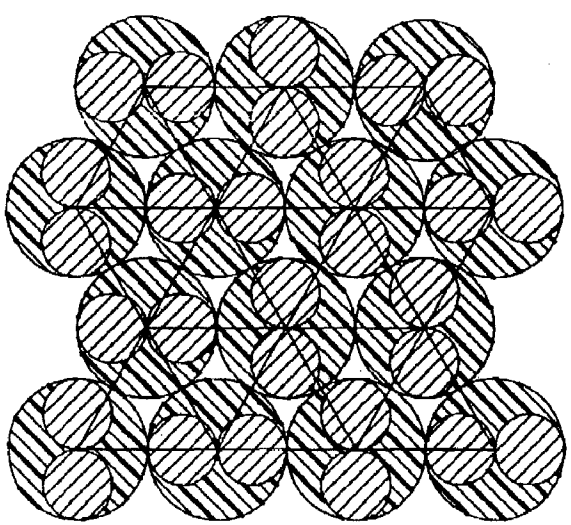
FIG. 3B shows the hexagonally arranged twisted pairs using different pitches between the neighboring rows to reduce the crosstalk among the twisted pairs when one of said twisted pairs is viewed at its 90-degree position
Figure 3A:
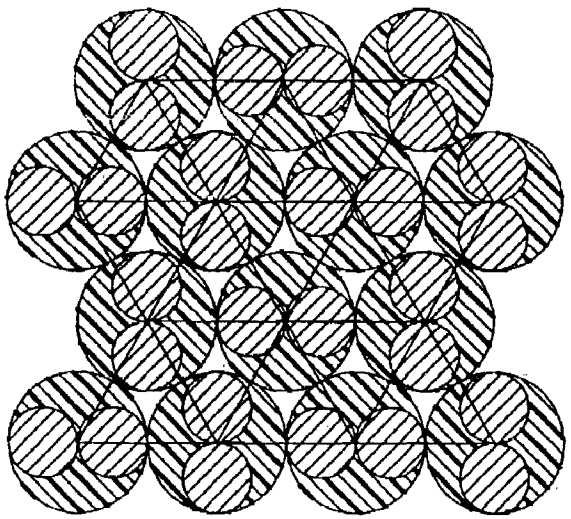
FIG. 3A shows the hexagonally arranged twisted pairs using different pitches between the neighboring rows to reduce the crosstalk among the twisted pairs when one of said twisted pairs is viewed at its 0 degree position.
Figure 4D:
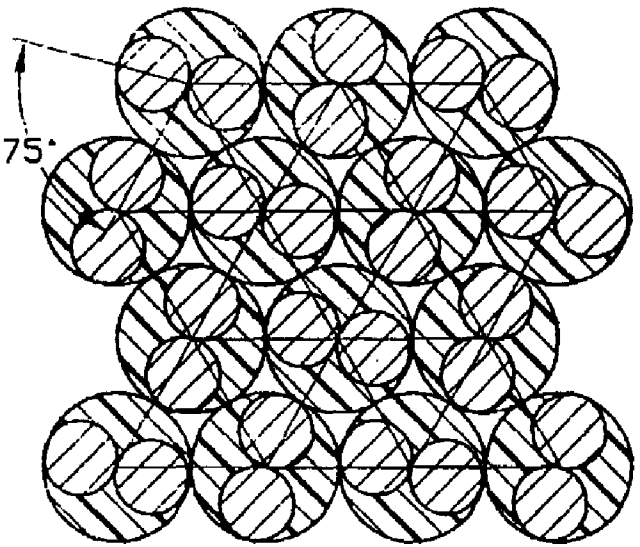
FIG. 4D shows the hexagonally arranged twisted pairs having a 90 degrees shift between the neighboring twisted pairs in the same row while having a 75 degrees phase shift between the neighboring twisted pairs in the different rows, when one of said twisted pairs is viewed at its 60-degree position.
Figure 4C:
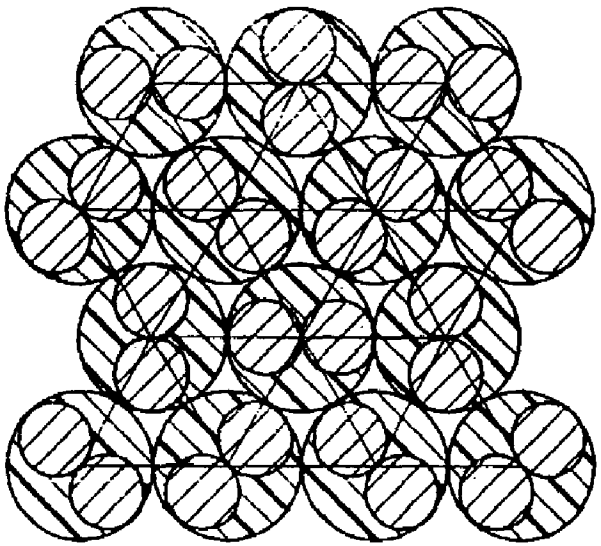
FIG. 4C shows the hexagonally arranged twisted pairs having a 90 degrees shift between the neighboring twisted pairs in the same row while having a 75 degrees phase shift between the neighboring twisted pairs in the different rows, when one of said twisted pairs is viewed at its 45-degree position.
Figure 5B:
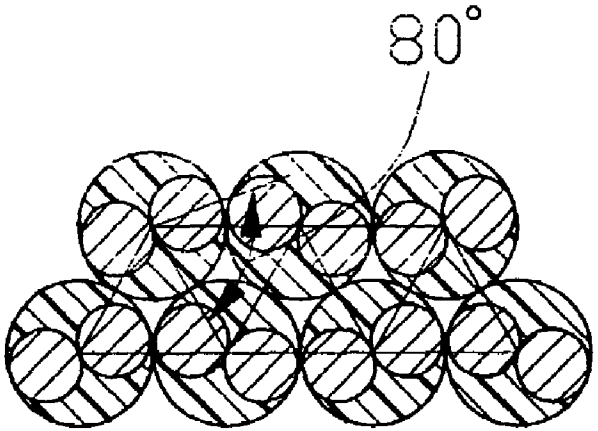
FIG. 5B shows the hexagonally arranged twisted pairs having the same phase shift between the neighboring twisted pairs regardless of whether in the same row or the same column when one of said twisted pairs is viewed at its 20-degree position.
Figure 5A:
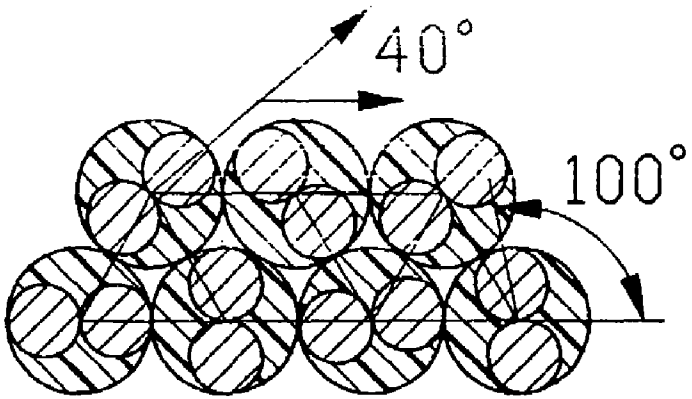
FIG. 5A shows the hexagonally arranged twisted pairs having the same phase shift between the neighboring twisted pairs regardless of whether in the same row or the same column when one of said twisted pairs is viewed at its 0-degree position.
Figure 5D:
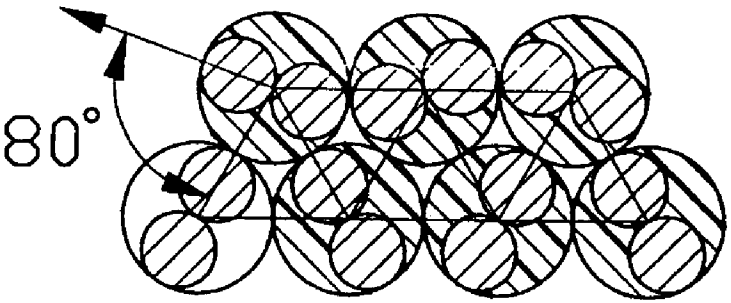
FIG. 5D shows the two-row hexagonally arranged twisted pairs having the same phase shift between the neighboring twisted pairs regardless of whether in the same row or the same column when one of said twisted pairs is viewed at its 40-degree position.
Figure 5C:
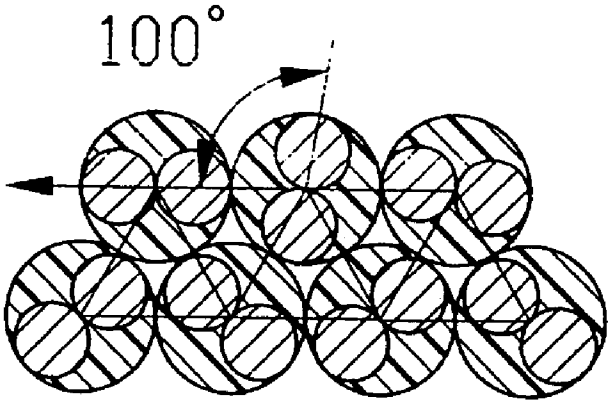
FIG. 5C shows the hexagonally arranged twisted pairs having the same phase shift between the neighboring twisted pairs regardless of whether in the same row or the same column when one of said twisted pairs is viewed at its 40-degree position.

Attention is directed to FIGS. 3A–3B wherein the twisted pairs in each same row are arranged with 90-degree phase shift between every adjacent two, and the pitch of one row is essentially a multiple of the adjacent one. Anyhow, the disadvantage of this embodiment is to require a long distance to achieve the effect, and not good for the higher frequency applications.

Referring to FIGS. 4A–4D, the twisted-pairs in each row have the same twisted direction and 90-degree phase shift between every adjacent twisted-pairs. For the different row with the different twisting direction, a best crosstalk noise cancellation can be achieved by an arrangement of 75 degree local phase shift angle through mathematical derivation when one twisted pair is aligned with the local zero-degree axis. The phase shift arrangement is also shown there is a global phase shift angle of 45 degrees for the neighbor rows when one twisted pair is aligned with the global zero-degree axis. Also, there is a global phase shift angle 90 degrees between very other rows when one twisted pair is aligned with the global zero-degree axis.

Referring to FIGS. 5A–5D, the best solution is to give all neighbor pairs with the same local phase shift angle. However, it can not be found. Instead, it is achieved in only two rows arrangement, not for the matrix-like structure. This comes out the maximum crosstalk noise cancellation at 80 or 100, (i.e, 180–80) degrees local shift through derivations when one twisted pair is aligned with the local zero-degree axis. The initial arrangement in the first row has a global phase shift angle 100 degrees with the same twisting direction when one twisted pair is aligned with the global zero-degree axis. And the arrangement in the second row has a global phase shift angle 100 degrees with the same twisting direction when one twisted pair is aligned with the global zero-degree axis. The neighbor rows have a global phase shift angle 40 degrees in the beginning with different twisting direction when one twisted pair of aligned with the global zero-degree axis. Conclusively, this arrangement will give a local phases shift angle 80 or 100 degrees, i.e., Row 1: 0, 100(−80), 200(120), 300(−60), 400(40), . . . , degrees and Row 2: 40, −60, −160(20), −260(100), −360(0), . . . , degrees.

The above embodiment is a 60 degrees example. The general compact packing arrangement with an angle of $\alpha$, which has a range between 60 for hexagonal compact packing to 90 degrees for quadrate compact packing.

Figure 6:
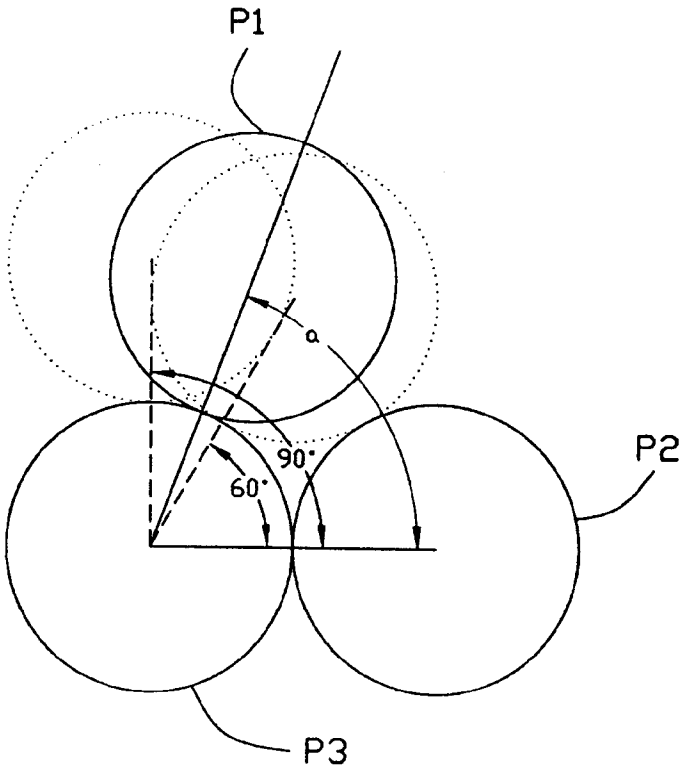
FIG. 6 shows the three neighboring twisted pairs may be arranged to form an included angle a defined by two center lines each connecting two centers.
Figure 7A:
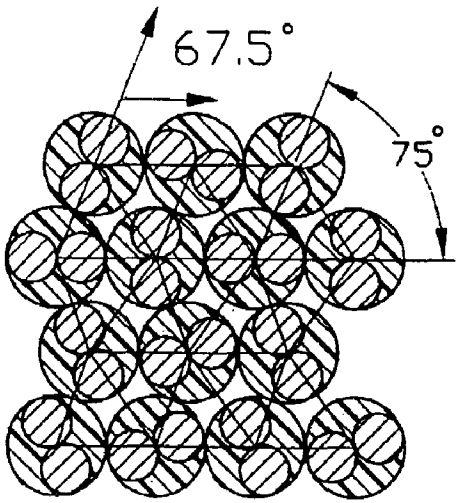
FIG. 7A shows the arranged twisted pairs, under $\alpha$=75 degrees, having a 90 degrees shift between the neighboring twisted pairs in the same row while having a 97.5 degrees phase shift between the neighboring twisted pairs in the different rows, when one of said twisted pairs is viewed at its 0-degree position.
Figure 7B:
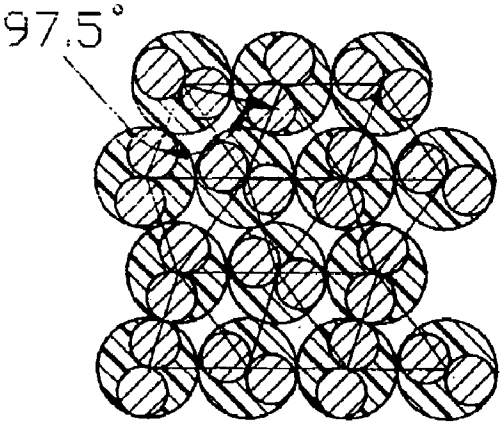
FIG. 7B shows the arranged twisted pairs, under $\alpha$=75 degrees, having a 90 degrees shift between the neighboring twisted pairs in the same row while having a 97.5 degrees phase shift between the neighboring twisted pairs in the different rows, when one of said twisted pairs is viewed at its 75-degree position.
Figure 7C:
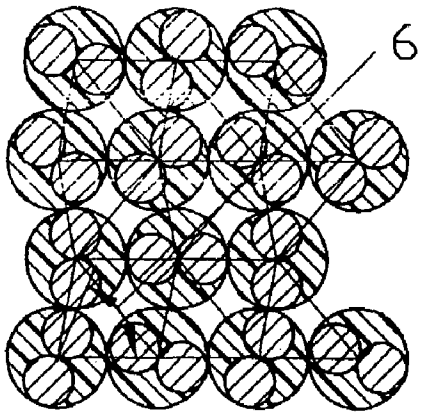
FIG. 7C shows the arranged twisted pairs, under $\alpha$=75 degrees, having a 90 degrees shift between the neighboring twisted pairs in the same row while having a 97.5 degrees phase shift between the neighboring twisted pairs in the different rows, when one of said twisted pairs is viewed at its 135-degree position.

Referring to FIGS. 6 and 7A–7C, any local phase shift angle other than 0 degree will cancel out some crosstalk noises. FIGS. 7A–7C are similar to FIGS. 4A–4D except $\alpha$ is not equal to 60 degrees but 75 degrees. The pairs in the same row have 90 degrees phase shift. The pairs in the different neighboring rows has a local phase shift angle under an equation of $[45+(\alpha/2)]$ or $[135-(\alpha/2)]$ degrees and a global phase shift angle under an equation of $+[(3\alpha/2)-45]$ or $-[(3\alpha/2)-45]$. Also, there is a global phase shift angle of $+2[(3\alpha/2)-45]$ or $-2[(3\alpha/2)-45]$ between the twisted pairs of every other row. It is seen that in FIGS. 7A–7C, according to the above equation, the global phase shift is 67.5 degrees and the local phase shift is 97.5 degrees.

Understandably, similar to FIGS. 5A–5D, the general equation for the local phase shift angle is $[60+(\alpha/3)]$ or $[120-(\alpha/3)]$. The initial arrangement in the first row has a global phase shift of $[(5\alpha/3)-60]$ and in the second row has a global phase shift of $-[(5\alpha/3)-60]$.

It should be noted that in FIG. 6 the twisted pair P1 is spaced from the twisted pair P2 while P1 contacts P3 and P2 contacts P3. Anyhow, P1 can be spaced from P3, and P2 can be spaced form P3 too under the same above equation.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included in the scope of the following claims.

I claim:

1. A cable includes a plurality of twisted pairs of conductors in a dense matrix-like form defining thereof horizontal rows and oblique columns with each other in a rectangular coordinate system wherein the twisted pairs in the same row have the same twist direction while having opposite twist directions with those in the two neighboring rows aside, and wherein for each row there is a local phase shift between every adjacent two pairs by following an equation of $[60+(\alpha/3)]$ or $[120-(\alpha/3)]$, and an initial arrangement in a first row has a global phase shift of $[(5\alpha/3)-60]$ and in a second row adjacent to said first row, has a global phase shift of $-[(5\alpha/3)-60]$, wherein $\alpha$ is an angle defined by every adjacent three twisted pairs which form an acute triangular cross-section.

2. The cable as described in claim 1, wherein each of said rows includes at least two twisted pairs of conductors.

3. The cable as described in claim 2, wherein said cable defines a hexagonal form.

4. The cable as described in claim 2, wherein $\alpha$ is equal to 60 degrees.

5. The cable as described in claim 1, wherein the cable includes at least five twisted pairs of conductors.

6. The cable as described in claim 5, wherein said cable defines a hexagonal form.

7. The cable as described in claim 5, wherein $\alpha$ is equal to 60 degrees.

8. The cable as described in claim 1, wherein each of said twisted pairs is not further twisted with any neighboring twisted pairs.

9. The cable as described in claim 8, wherein said cable defines a hexagonal form.

10. The cable as described in claim 8, wherein $\alpha$ is equal to 60 degrees.

11. A cable includes a plurality of twisted pairs of conductors in a dense matrix-like form defining thereof horizontal rows and oblique columns with each other in a rectangular coordinate system wherein the twisted pairs in the same row have the same twist direction while having opposite twist directions with those in the two neighboring rows aside, and wherein for each row there is a local phase shift between every adjacent two pairs by following an equation of $[45+(\alpha/2)]$ or $[135-(\alpha/2)]$ degrees and a global phase shift angle under an equation of $+[(3\alpha/2)-45]$ or $-[(3\alpha/2)-45]$ wherein $\alpha$ is an angle defined by every adjacent three twisted pairs which form an acute triangular cross-section.

12. The cable as described in claim 11, wherein there is a global phase shift angle of $+2[(3\alpha/2)-45]$ or $-2[(3\alpha/2)-45]$ between the twisted pairs of every other row.

13. The cable as described in claim 12, wherein $\alpha$ is equal to 75 degrees.

14. The cable as described in claim 11, wherein each of said rows includes at least two twisted pairs of conductors.

15. The cable as described in claim 11, wherein the cable includes at least five twisted pairs of conductors.

16. The cable as described in claim 11, wherein each of said twisted pairs is not further twisted with any neighboring twisted pairs.

* * * * *